United States Patent [19]

Miyata

[11] Patent Number: 4,685,503

[45] Date of Patent: Aug. 11, 1987

[54] METHOD OF MANUFACTURING A DISINTEGRATABLE CORE FOR CASTING

[75] Inventor: Kinichi Miyata, Ichinomiya, Japan

[73] Assignee: Aisin Seiki Kabushiki Kaisha, Kariya, Japan

[21] Appl. No.: 939,286

[22] Filed: Dec. 4, 1986

Related U.S. Application Data

[63] Continuation of Ser. No. 815,781, Jan. 3, 1986, abandoned, which is a continuation of Ser. No. 631,311, Jul. 16, 1984, abandoned.

[30] Foreign Application Priority Data

Sep. 12, 1983 [JP] Japan ..... 58-166772

[51] Int. Cl.[4] ..... B22C 1/22; B22C 3/00; B22C 9/10

[52] U.S. Cl. ..... 164/14; 106/38.27; 164/72; 164/138; 164/369; 427/134

[58] Field of Search ..... 164/523, 522, 14, 138, 164/369, 72; 427/134; 106/38.22, 38.27

[56] References Cited

U.S. PATENT DOCUMENTS

| | | | |
|---|---|---|---|
| 3,501,320 | 3/1970 | Pietryka et al. | 106/38.27 |
| 4,443,259 | 4/1984 | Nooden | 164/14 X |

FOREIGN PATENT DOCUMENTS

| | | | |
|---|---|---|---|
| 769017 | 12/1971 | Belgium | 427/134 |
| 57-85635 | 5/1982 | Japan | 164/138 |

*Primary Examiner*—J. Reed Batten, Jr.

*Attorney, Agent, or Firm*—Oblon, Fisher, Spivak, McClelland, & Maier

[57] ABSTRACT

A core is formed by molding a mixture of an organic binding material and a fireproof granular substance. The core is impregnated with an aluminum-phosphorus oxide solution. The impregnated core is heated at 400°–1000° C. for about an hour.

The disintegrable core for casting can be produced much more quickly than before and with considerably less expenditure of energy.

8 Claims, No Drawings

METHOD OF MANUFACTURING A DISINTEGRATABLE CORE FOR CASTING

CROSS-REFERENCE TO RELATED APPLICATIONS

This application is a continuation of application Ser. No. 815,781 filed Jan. 3, 1986 which in turn is a continuation of application Ser. No. 631,311 filed July 16, 1984 and both now abandoned.

BACKGROUND OF THE INVENTION

1. Field of the Invention

This invention relates generally to a method of manufacturing a disintegrable core for castings. More particularly, the present invention relates to a method of manufacturing a disintegrable core for castings, wherein the core so produced is especially characterized by excellent strength and disintegratability.

2. Description of the Prior Art

In the pressure die casting method, a molten metal is placed into a mold under pressure. According to this method, a core which is used in the process must have sufficient strength to tolerate unequal pressure which is generated when the mold is being filled with the molten metal.

A conventional core for the pressure die casting method is made of melted moldings of a mixture of sodium silicate ($Na_2O.SiO_2$) and sodium disilicate ($Na_2O.2SiO_2$). While such a core has a sufficient strength, when used in the production of aluminum castings a core containing this composition corrodes the aluminum casting products due to the strong alkalinity of the water solution thereof. Therefore, a core containing this composition cannot be used in the casting of aluminum or zinc products.

Another conventional core of this type is disclosed in Japanese Patent Publication No. 56-22420. This core is made by mixing an organic binding material into a fireproof granular substance, molding the mixture of the organic binding material and the fireproof granular substance to a prescribed shape, impregnating the moldings with water glass, prepared with sodium oxide ($Na_2O$) at a concentration of 1.2 to 2.2%, and then heating the impregnated moldings. The casting products prepared with this core can be prepared with good quality, even if aluminum or zinc products are cast, as the casting products of aluminum or zinc are not corroded by this core. Unfortunately, when casting an aluminum piston with such a core, good results cannot be obtained due to the non-disintegratability of this core.

An additional conventional method of manufacturing a core is disclosed in Japanese Patent publication 56-22420. While the core in this publication is described as being disintegratable, a hard condition for heating is mandatory. Temperatures typically in excess of 1300° C. for about 24 hours duration are required.

Therefore, a need continues to exist for a core for castings which does not corrode cast products of aluminum or zinc, which also has sufficient strength and which is also disintegrable. Also, it would be extremely desirable to be able to produce such a core with lower temperatures for shorter durations to reduce the expenditure of energy.

SUMMARY OF THE INVENTION

Accordingly, it is an object of the present invention to produce a core for pressure die casting which has sufficient strength and which does not corrode cast products made of aluminum or zinc.

It is also an object of this invention to provide a core for pressure die casting which is readily disintegrable.

Moreover, it is an object of the present invention to provide an improved method of manufacturing a disintegrable core for castings wherein the core produced has excellent disintegratability.

It is another object of the present invention to provide an improved method of manufacturing a disintegrable core for castings which maintains adequate core strength while improving the disintegratability of the core.

Moreover, it is still another object of the present invention to provide an improved method of manufacturing a disintegrable core for castings which conserves energy in the heat treatment of the core.

According to the present invention, the foregoing and other objects are obtained by providing a method of manufacturing a disintegrable core for castings, which entails mixing an organic binding material into a fireproof granular substance, molding the mixture to a prescribed shape, impregnating the molded mixture with an aluminum phosphorous oxide ($Al_2O_3$-$P_2O_5$) water solution %, and heating said impregnated moldings at a temperature of about 400° to 1000° C.

DETAILED DESCRIPTION OF THE PREFERRED EMBODIMENTS

The method of manufacturing a disintegrable core for castings according to the present invention entails coating and organic binding material on a fireproof granular substance. The organic binding material may be a phenolic resin or a furan resin, for example, and is coated in the amount of about 2 to 3 wt. %. The fireproof granular substance may be, for example, zircon sands of, for example, about 100 to 150 mesh. This coated product is molded to a prescribed cylindrical shape by a shell molding machine. A water solution containing aluminum-phosphorus oxide ($Al_2O_3/P_2O_5$) in the amount of about 13–29 wt % is used to impregnate the moldings. The mixed oxide is about 40 wt. % in solids and the solution can be prepared by mixing about 0.4 wt parts of aluminum-phosphorus oxide to about 1 mole of water. In general, 0.4 to 1 wt. part of the mixed oxide can be used per 1 part of water.

The moldings are dipped into the solution for impregnation. The concentration of the aluminum-phosphorus oxide is restricted in 0.4 to 1 wt. part per 1 wt. part of water for the following reasons. If the aluminum-phosphorus oxide is less than 0.4 wt. parts per wt. part of water, after heat treatment of the moldings described hereinafter, the prescribed strength of the core cannot be obtained. On the other hand, if the aluminum-phosphorus oxide is more than 1 wt. part per wt. part of water, the disintegratability of the core, after pouring in the casting process, decreases greatly due to the promotion of hardening in the core after heat treatment of the core. Also, the amounts of aluminum oxide and phosphorus oxide in the mixture can be in any particular ratio. However, it is advantageous to use approximately equal parts of each oxide in the mixture.

With respect to methods of impregnating the moldings with the mixed oxide water solution, dipping is the most desirable method, but, the impregnation can be obtained by other methods such as spraying of the moldings.

After impregnation of the moldings with the aluminum-phosphorus oxide water solution, the moldings are removed from the solution and then dried. By this method, the aluminum-phosphorus oxide is impregnated into the moldings and is hardened. After drying the moldings, the moldings are heated at a temperature of about 400° to 1000° C. More particularly, the temperature range of about 700° to 1000° C. is the most desirable. The most desirable time for the heat treatment is about 1 hour.

By the heat treatment, the phenolic resin is overheated, and thereby is pyrolyzed and disappears. Although, the organic binding material is vaporized and disappears by heat treatment, the decomposition of the organic binding material is necessary so as to prevent the generation of gas when pouring occurs during the casting process. In order to prevent gas generation, the temperature of heat treatment is selected to be equal to or greater than the temperature of pouring during casting.

In the first step of the process according to the present invention, a fireproof granular substance is mixed with an organic binding material. The fireproof granular substance may be substances such as silica sand or zircon sand. The organic binding material may be a thermosetting resin, a reactive resin, a self-hardening resin or a waterproof resin. Of particular significance are the phenolic resins and furan resins. The mixture is then molded.

The molded mixture is then impregnated with the aluminum-phosphorus oxide water solution by any effective means of impregnation. The preferred means are impregnation by dipping or by spraying. The aluminum-phosphorus oxide water solution as applied has a concentration of about 13 to 29 wt. %. Advantageously, an agent is used with the aluminum-phosphorus oxide water solution which prevents gelation of the aluminum-phosphorus oxide water solution. Of particular use are surface active agents such as polyhydric alcohols, including specific agents such as glycerol, or α-olefins in the amount of about 1 to 3 wt. %. Also bromic acid, tartaric acid or citric acid in the amount of about 1 wt. % can be used with the polyhydric alcohols or α-olefins. These agents when combined offer excellent protection against the gelation of the aluminum-phosphorus oxide water solution.

After impregnation and drying, the impregnated, molded mixture is heated to a temperature of about 400° to 1000 C. More particular, this mixture is heated to a range of about 700° to 1000° C. for a period of about 1 hour.

The present invention will now be further illustrated by certain examples and references which are provided for purposes of illustration only and are not intended to limit the present invention.

EXAMPLE 1

A raw material cylindrical piston (external diameter: 90 mm, length: 18 mm), of aluminum cast products is poured at a temperature of 750° C. into a casting mold, utilizing the core made according to the process of the present invention. Then, after cooling naturally, a shock is applied to the core by a pneumatic hammer, and the core is easily disintegrated. Furthermore, it is also noted that core breaking within casting products can be accomplished from a sized 8 mm.

As previously mentioned, in a conventional method of manufacturing of disintegrable core as disclosed in Japanese Publication 56-22420, a hard condition for heating is required for the heat treatment of the core. The temperatures of such a heat treatment typically are higher than 1300° C. in temperature with a duration of about 24 hours. In sharp contrast to this, the heat treatment of the core can now be effected, according to the process of the present invention, with a temperature of only about 400° to 1000° C. for as little as 1 hour. Hence, according to the present invention, the disintegrable core for casting can now be made much quicker than before and with considerably less expenditure of energy.

Having now fully described the present invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method of manufacturing a disintegrable core for castings, which consists essentially of:

(a) mixing an organic binding material with a fireproof granular substance, (b) molding said mixture to form a core of a prescribed shape, (c) impregnating said molded core with an aluminum-phosphorus oxide water solution which has a concentration of about 13 to 29 weight percent, to thereby form an impregnated core, and (d) heating said impregnated core at a temperature of about 400° to 1000° C. for about 1 hour.

2. The method of manufacturing a disintegrable core for castings as set forth in claim 1, wherein said impregnation is effected by dipping or spraying.

3. The method of manufacturing a disintegrable core for castings as set forth in claim 1, wherein said aluminum-phosphorus oxide water solution has about 0.4 to 1 wt. part of mixed aluminum-phosphorus oxide to about 1 wt. part of water.

4. The method of manufacturing a disintegrable core for castings as set forth in claim 1, wherein said organic binding material is a phenolic resin or a furan resin.

5. The method of manufacturing a disintegrable core for castings as set forth in claim 1, wherein said fireproof granular substance is silica sand or zircon sand.

6. The method of manufacturing a disintegrable core for castings as set forth in claim 5, wherein said fireproof granular substance is zircon sand of about 100–150 mesh.

7. The method of manufacturing a disintegrable core for castings as set forth in claim 1, wherein said aluminum-phosphorus oxide water solution further comprises surface active agents of polyhydric alcohols or α-olefins in the amount of about 1–3% by wt. and bromic acid, tartaric acid or citric acid in the amount of about 1% to hinder gelation.

8. A disintegrable core for castings produced by the method as set forth in claim 1.

* * * * *

UNITED STATES PATENT AND TRADEMARK OFFICE

CERTIFICATE OF CORRECTION

PATENT NO. : 4,685,503

DATED : August 11, 1987

INVENTOR(S) : Kinichi MIYATA

It is certified that error appears in the above-identified patent and that said Letters Patent is hereby corrected as shown below:

Column 2, line 28, change "phosphorous" to --phosphorus--.

Column 3, line 52, change "particular" to --particularly--.

Signed and Sealed this

Fifth Day of April, 1988

*Attest:*

*Attesting Officer*

DONALD J. QUIGG

*Commissioner of Patents and Trademarks*